US005934106A

United States Patent [19]

Mc Poland et al.

[11] Patent Number: 5,934,106

[45] Date of Patent: Aug. 10, 1999

[54] APPARATUS AND METHOD FOR PRODUCING NITROGEN

[75] Inventors: Kurt V. Mc Poland, Madison; Jennifer A. Goodbody, Basking Ridge; Charles M. Brooks, Plainfield, all of N.J.

[73] Assignee: The BOC Group, Inc., New Providence, N.J.

[21] Appl. No.: 09/013,830

[22] Filed: Jan. 27, 1998

[51] Int. Cl.[6] ..... F25J 3/00

[52] U.S. Cl. ..... 62/652; 62/645

[58] Field of Search ..... 62/645, 652

[56] References Cited

U.S. PATENT DOCUMENTS

| | | | |
|---|---|---|---|
| 4,617,037 | 10/1986 | Okada et al. | 62/652 |
| 5,396,772 | 3/1995 | McKeigue et al. | 62/652 |
| 5,419,136 | 5/1995 | McKeigue | 62/645 |
| 5,582,034 | 12/1996 | Naumovitz | 62/652 |

*Primary Examiner*—Ronald Capossela
*Attorney, Agent, or Firm*—David M. Rosenblum; Salvatore P. Pace

[57] ABSTRACT

An apparatus and method for separating nitrogen within a single column nitrogen generator in which refrigeration is added by waste expansion. Part of the incoming air stream after having been partially cooled is turbo-expanded to increase the refrigeration supplied, thereby to allow the removal of the liquid nitrogen product.

13 Claims, 2 Drawing Sheets

APPARATUS AND METHOD FOR PRODUCING NITROGEN

BACKGROUND OF THE INVENTION

The present invention relates to an apparatus and method for producing nitrogen from a single column nitrogen generator. More particularly, the present invention relates to such an apparatus and method in which refrigeration is added by waste expansion. Evan more particularly, the present invention relates to such an apparatus and method in which a liquid product is produced by provision of additional air expansion.

There are many prior methods and apparatus by which nitrogen is produced in a single column known as a single column nitrogen generator. In such processes, air is compressed and then purified to remove carbon dioxide and moisture as well as potentially dangerous hydrocarbons. The compressed and purified air is then cooled in a main heat exchanger to a temperature suitable for its rectification which is normally at or near the dew point of air at the particular compression pressure. The air is then introduced into a distillation column to produce a nitrogen rich tower overhead and an oxygen enriched liquid column bottoms. The tower overhead is condensed and returned to the column for reflux purposes. A remaining part of the tower overhead may then be taken as a gaseous nitrogen product which fully warms in the main heat exchanger, thereby helping to cool the incoming air. Nitrogen of lesser purity can also be taken and passed through the main heat exchanger as a waste stream. Such waste stream can be used to regenerate the purifier.

In any air separation scheme, the power consumed is a very important consideration. In U.S. Pat. No. 4,966,002, a waste stream composed of the liquid column bottoms is valve expanded and then used as a coolant in the head condenser. The waste stream is then divided into two parts. One part of the waste stream is partially warmed and then expanded and the other part of the waste stream is recompressed and returned back to the column. The compression can either take place at the warm or cold end temperatures of the main heat exchanger. Increased efficiency has been realized by removing a liquid stream from the column having a higher nitrogen content than the column bottoms. Such liquid stream is then also valve expanded and introduced into the head condenser to act as a secondary coolant to help condense tower overhead for reflux purposes. The waste stream is partially warmed, expanded with the performance of work and then discharged from the main heat exchanger. The liquid stream that acts as a secondary coolant is recompressed after having served as a coolant, cooled back to its dew point temperature and reintroduced into the column.

In plants, such as those described above, it is difficult to supply sufficient refrigeration to generate liquid directly from the column. This is because the work of expansion, above that required to compress the recirculated stream must be discharged from the process as heat. Thus, in another patent, a nitrogen liquefier is integrated into the process in order to generate the liquid. The disadvantage of such integration is in the added expenses involved in supplying the equipment for the nitrogen liquefier.

As will be discussed, the present invention provides a method of producing a liquid nitrogen product from a single column nitrogen generator that is far simpler and more capital efficient than providing a separate nitrogen liquefier.

SUMMARY OF THE INVENTION

The present invention provides an apparatus for separating nitrogen from air. In accordance with the invention, a distillation column is configured to rectify the air so as to produce a tower overhead enriched in the nitrogen and a liquid column bottoms enriched in the oxygen. A head condenser is connected to the distillation column so as to receive a tower overhead stream composed of the tower overhead and a coolant stream composed of the liquid column bottoms. The head condenser is configured to liquefy the tower overhead stream, thereby to produce a reflux stream to reflux the distillation column and a liquid product stream. A main heat exchanger is provided with passages configured to cool a first part of the compressed and purified air stream to a temperature suitable for its rectification and to partially cool a second part of the compressed and purified air stream. The main heat exchanger is connected to the distillation column so that the first part of the compressed and purified air stream is introduced therewithin. First and second expansion means are connected to the main heat exchanger to expand a partially warmed stream and to expand the second part of the compressed and purified air stream, respectively. At least one refrigerant stream is produced as a product of the first and second expansion machines. The passages of the main heat exchanger are also configured to fully warm the at least on refrigerant stream, thereby, to allow for production of the liquid product stream.

In another aspect, the present invention relates to such an apparatus and method in which air is rectified within a distillation column so as to produce therefrom a tower overhead enriched in nitrogen and the liquid column bottoms enriched in oxygen. A tower overhead stream composed of the tower overhead is liquefied. A reflux stream is produced therefrom to reflux a distillation column and also, to produce a liquid product stream. A first part of the compressed and purified air stream is cooled to a temperature suitable for its rectification. A second part of the compressed and purified air stream is partially cooled. The first part of the compressed and purified air stream is introduced into the distillation column. At least one refrigerant stream is produced by expanding with the performance of work, a partially warmed stream and the second part of the compressed and purified air stream. Heat is indirectly exchanged between the first and second parts of the compressed and purified air and the at least one refrigerant stream thereby to allow production of the liquid product stream.

In the present invention, additional refrigeration is produced by an additional expander which acts to expand part of the air stream. This expanded part of the air stream is then introduced in countercurrent flow to the incoming air entering the main heat exchanger. The partially warmed stream can be a waste stream composed of all or part of a waste stream generated by vaporizing liquid column bottoms used as a coolant in the head condenser of the distillation column. Warmed, expanded air is then discharged from the plant. Preferably, the air and waste nitrogen streams are fully warmed and are discharged from the plant. It is this increase in refrigeration that allows for the production of the liquid product. As can be appreciated, the addition of a single expander is far less complex than the addition of a nitrogen liquefier used to accomplish the same purpose.

It is to be noted that the term "partially warmed" as used herein and in the claims mean warmed to a temperature that is between the hot and cold ends of the main heat exchanger. The term "fully warmed" as used herein and in the claims means warmed to a temperature of the warm end of the main heat exchanger. "Partially cooled" as used herein and in the claims means cooled to a temperature that is between the hot and cold ends of the main heat exchanger.

BRIEF DESCRIPTION OF THE DRAWINGS

While the present invention concludes with claims distinctly pointing out the subject matter that Applicants regard a certain invention, it is believed the invention will be better understood when taken in connection with accompanying drawings in which:

Figure 1:
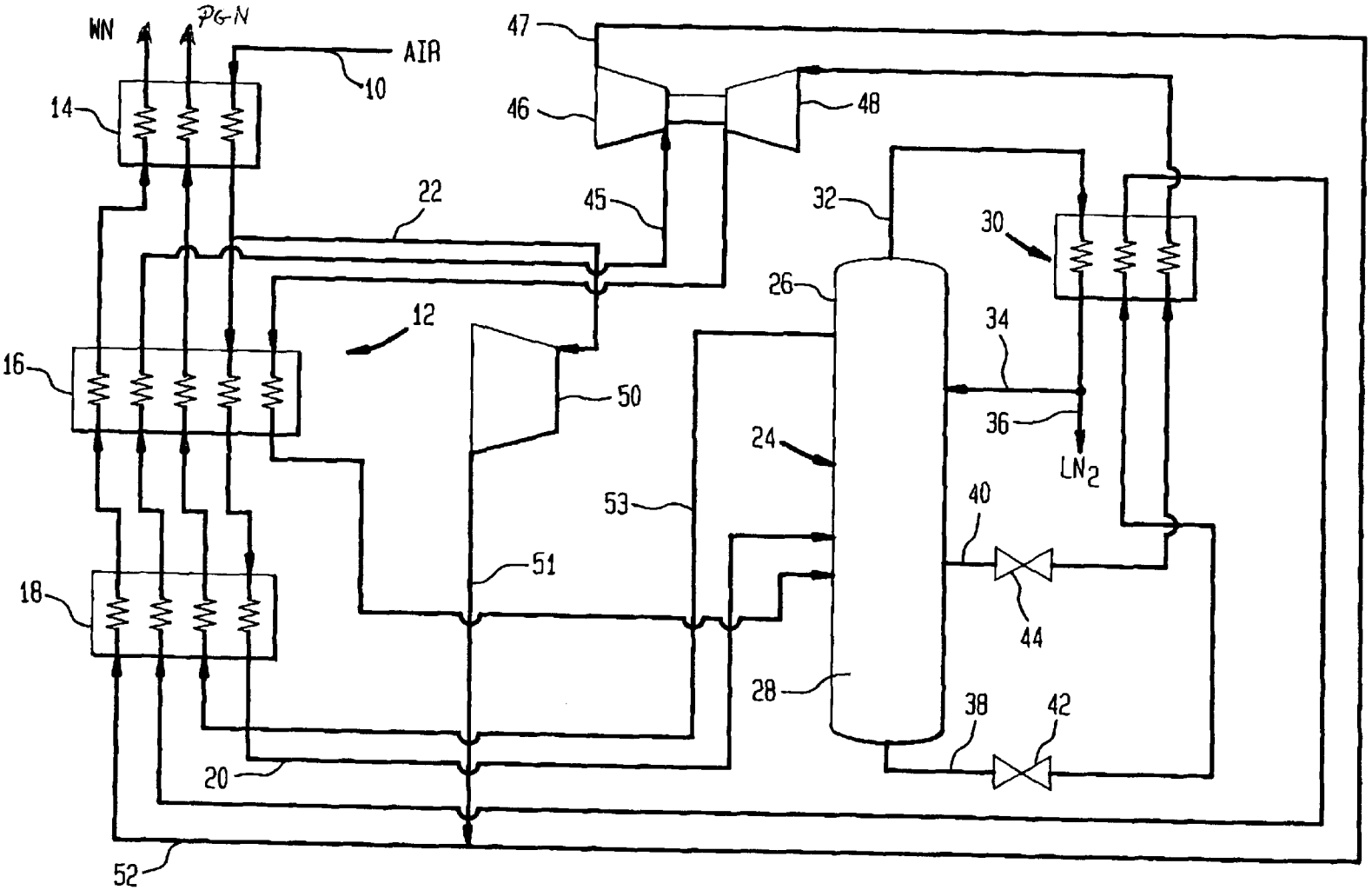
FIG. 1 is schematic illustration of an apparatus for carrying out a method in accordance with the present invention.
Figure 2:
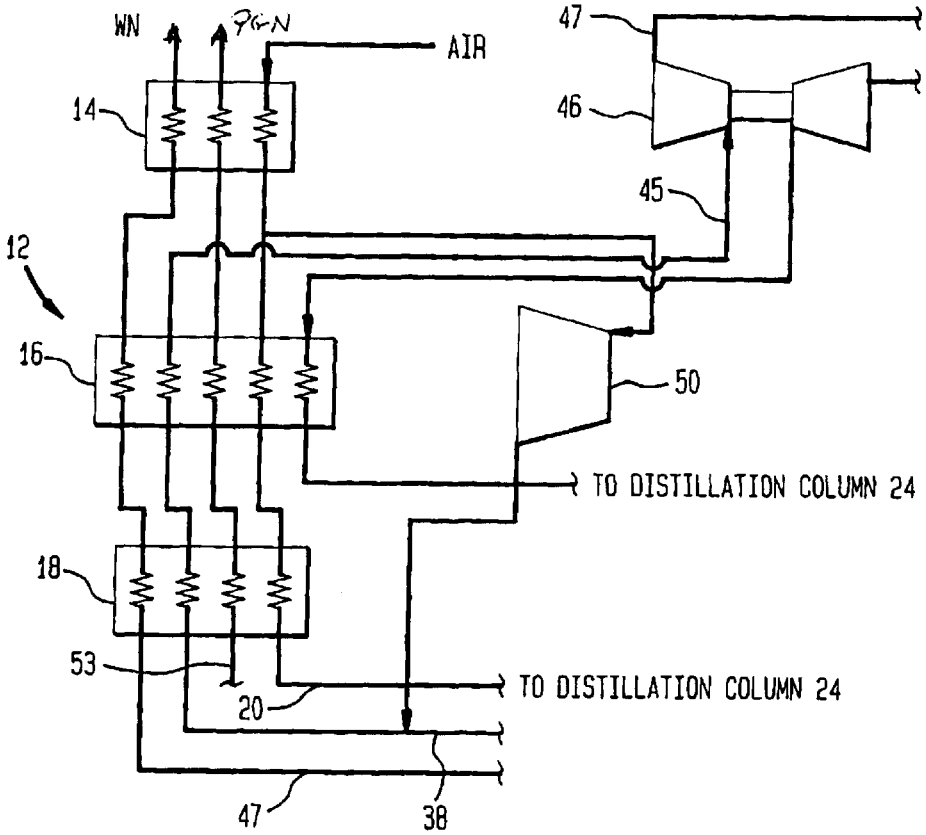
FIG. 2 is a fragmentary view of an alternative embodiment of the apparatus illustrated in FIG. 1.
Figure 3:
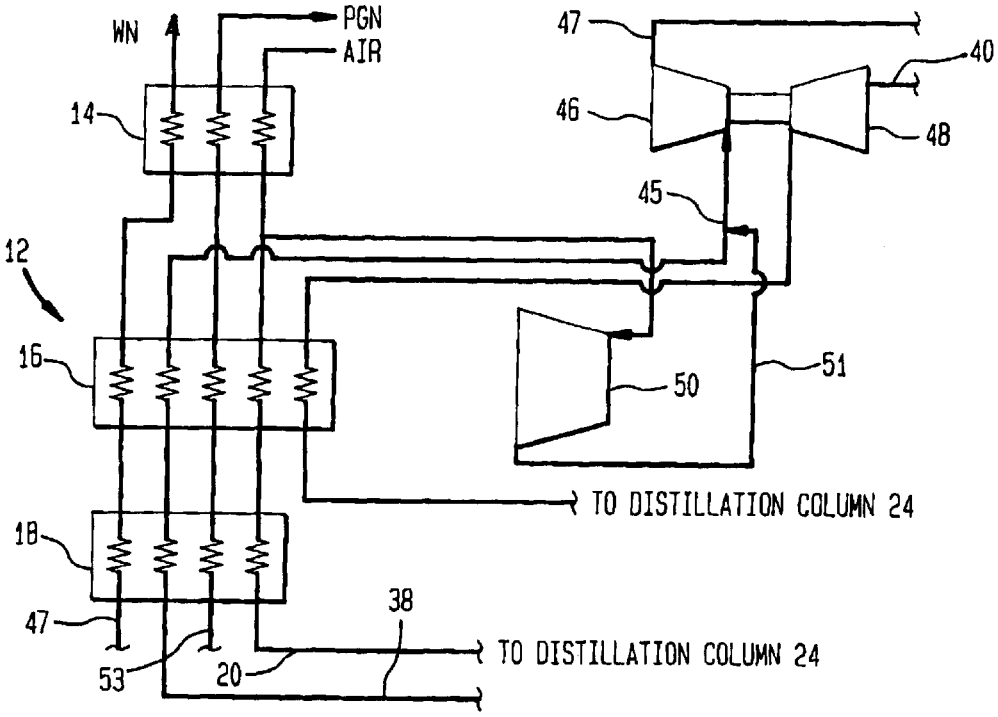
FIG. 3 is a fragmentary view of yet another alternative embodiment of the apparatus illustrated in FIG. 1.

For the sake of brevity of explanation, the reference numbers used in FIG. 1 are used on like components shown in FIGS. 2 and 3. Other than the changes specifically illustrated in FIGS. 2 and 3, the remainder of the schematics, not shown, is the same as that of FIG. 1.

DETAILED DESCRIPTION

With reference to the figure, air separation apparatus 1 in accordance with the present invention is illustrated. Air, after having been compressed is cooled to remove the heat of compression and is purified. The purification can take place in any one of a number of known devices such as a pressure swing absorption unit having beds operating out of phase to remove moisture, carbon dioxide and hydrocarbons from the incoming feed.

The resultant compressed and purified air stream 10 is then introduced into a heat exchanger complex 12 having elements 14, 16, and 18. After the air has been partially cooled, a first part 20 thereof is cooled to a temperature suitable for its rectification while a second part 22 is discharged from heat exchanger complex 12 in a partially cooled state. First part 20 of the compressed and purified air stream is then introduced into a distillation column 24 which can have mass transfer elements such as trays, packing, either random or structured, in order to contact the ascending vapor phase of the air with a descending liquid phase initiated at the top of distillation column 24. As a result, tower overhead, enriched in nitrogen is produced within a top region 26 of distillation column 24. An oxygen enriched liquid column bottoms is produced within a bottom sump region 28 of distillation column 24.

A head condenser 30 is connected to the distillation column so as to receive a tower overhead stream 32. The tower overhead stream 32 is liquefied within head condenser 30 to produce a reflux stream 34, to initiate formation of the descending liquid phase within distillation column 24, and a liquid product stream 36, labeled, "$LN_2$."

Coolant for the head condenser 30 consists of a first coolant stream 38 composed of the oxygen enriched liquid column bottoms and preferably a second coolant stream 40 which consists of liquid removed from distillation column 24 having a greater nitrogen content than the column bottoms. The first and second coolant streams 38 and 40 are expanded in expansion valves 42 and 44, respectively, to lower their pressure and therefore their temperature. First and second cooling streams 42 and 44 vaporize within head condenser 30.

First coolant stream 38, after having been vaporized, forms a waste stream that is then partly warmed within heat exchanger complex 12 to produce a partially warmed stream 45. Partially warmed stream 45 is then expanded within an expansion machine, preferably a turboexpander 46 to produce a refrigerant stream 47. The second coolant stream 40 after having been vaporized is then recompressed in a recycle compressor 48 and cooled to dew point temperature in heat exchanger complex 12. The resultant compressed coolant stream 40 is then recycled back to distillation column 24. Turboexpander 46 can be coupled to recycle compressor 48 so that the work of expansion is partly recovered in the recycle compressor and partly by a variety of known energy dissipative devices such as an electrical generator or a brake.

In order to make the liquid product, the second part of the compressed and purified air stream 22 is turbo-expanded within a turboexpander 50 to produce a refrigerant stream 51. Refrigerant stream 51 is combined with refrigerant stream 47 to produce a refrigerant stream 52 that is introduced into the cold end of heat exchanger complex 12 where it fully warms. It is understood, that (although more expensive) separate passages could be provided within main heat exchanger complex 12 for refrigerant streams 47 and 51. It is the presence of the second turboexpander 50 and the turbo-expansion of the second part of the compressed and purified air stream 22 which allows for the production of liquid and the take off as liquid product stream 36. Although not illustrated, turboexpander 50 can be coupled to a known energy dissipative device.

With reference to FIG. 2, an alternative embodiment is illustrated in which first coolant stream 38 again vaporizes within head condenser 30 to produce a waste stream which is combined with refrigerant stream 51. The resultant combined stream is then partially warmed to form partially warmed stream 45. Partially warmed stream 45 is expanded to produce refrigerant stream 47 which is then fully warmed within main heat exchanger complex 12.

With additional reference to FIG. 3, an embodiment of the present invention is illustrated in which first coolant stream 38 vaporizes within head condenser 30 to produce a waste stream that is partially warmed and then combined with refrigerant stream 51 to produce partially warmed stream 45. Partially warmed stream 45 is expanded to produce refrigerant stream 47 which is then fully warmed within main heat exchanger complex.

A gaseous product stream 53 can also be taken from top region 26 of distillation column 24. Gaseous product stream 53 fully warms with a main heat exchanger complex 12 where it is discharged as a product gas nitrogen stream labeled "PGN."

While the present invention has been described with reference to preferred embodiment, as will occur to those skilled in the art, numerous changes, additions and omissions may be made without departing from the spirit and scope of the present invention.

We claim:

1. An apparatus for separating nitrogen from air comprising:

a distillation column configured to rectify the air so as to produce therefrom a tower overhead enriched in said nitrogen and a liquid column bottoms enriched in oxygen;

a head condenser connected to said distillation column so as to receive a tower overhead stream composed of said tower overhead and configured to liquefy said tower overhead stream, thereby to produce a reflux stream to reflux said distillation column and a liquid product stream;

a main heat exchanger having passages configured to cool a first part of a compressed and purified air stream to a temperature suitable for its rectification and to partially cool a second part of a compressed and purified air stream;

said main heat exchanger connected to said distillation column so that said first part of said compressed and purified air stream is introduced therewithin; and first and second expansion machines connected to said main heat exchanger to expand a partially warmed stream and to expand said second part of said compressed and purified air stream, respectively, thereby to produce at least one refrigerant stream as a product of said first and second expansion machines;

the passages of said main heat exchanger also configured to receive and to fully warm said at least one refrigerant stream, thereby to introduce refrigeration and to allow for production of said liquid product stream.

2. The apparatus of claim 1, wherein:

said head condenser is also connected to said distillation column so that a coolant stream composed of said liquid column bottoms vaporizes within said heat condenser and thereby forms a waste stream; and the passages of said main heat exchanger are also configured to partially warm said waste stream, thereby to produce said partially warmed stream.

3. The apparatus of claim 1, wherein:

said head condenser is also connected to said distillation column so that a coolant stream composed of said liquid column bottoms vaporizes within said heat condenser and thereby forms a waste stream; and said second expansion machine and head condenser are connected to said main heat exchanger so that said waste stream and said second part of said compressed and purified air stream after having been expanded combine and partially warm within said main heat exchanger to form said partially warmed stream.

4. The apparatus of claim 1, wherein:

said head condenser is also connected to said distillation column so that a coolant stream composed of said liquid column bottoms vaporizes within said heat condenser and thereby forms a waste stream;

the main heat exchanger is connected to said head condenser to partially warm the waste stream; and the second expansion machine and the main heat exchanger are connected so that the partially warmed stream is formed from the second part of the compressed and purified air stream after having been expanded in said waste stream.

5. The apparatus of claim 2 or claim 3 or claim 4, wherein:

said coolant stream comprises a first coolant stream;

said head condenser is also connected to said distillation column to receive a second coolant stream composed of a liquid phase of said first part of said compressed and purified air stream having a greater nitrogen content than that of said column bottoms;

an expansion valve is interposed between said head condenser and said distillation column to expand said second coolant stream;

a recycle compressor is connected to said heat condenser to recompress said second coolant stream to column pressure of said distillation column; and said main heat exchanger is connected between to said recycle compressor and said distillation column to return said second coolant stream back to said distillation column after having been recompressed and its said heat exchange passages are also configured to cool said second coolant stream to at or near dew point temperatures.

6. The apparatus of claim 1, wherein said first and second expansion machines comprise turboexpanders.

7. The apparatus of claim 5, wherein said main heat exchanger is connected to said distillation column and its said passages are also configured to receive a gaseous stream composed of said tower overhead and fully warm said gaseous stream, thereby to form a gaseous product nitrogen stream.

8. A method of separating nitrogen from air comprising:

rectifying the air within a distillation column so as to produce therefrom a tower overhead enriched in said nitrogen and a liquid column bottoms enriched in oxygen;

liquefying a tower overhead stream composed of said tower overhead against vaporizing a waste stream and producing therefrom a reflux stream to reflux said distillation column and a liquid product stream;

cooling a first part of a compressed and purified air stream to a temperature suitable for its rectification and partially cooling a second part of a compressed and purified air stream;

introducing said first part of said compressed and purified air stream is into said distillation column;

producing at least one refrigerant stream by expanding with the performance of work, a partially warmed stream and said second part of said compressed and purified air stream; and indirectly exchanging heat between said first and second parts of said compressed and purified air and said refrigerant stream thereby to introduce refrigeration and to allow production of said liquid product stream.

9. The method of claim 8, wherein:

said tower overhead stream is condensed against vaporizing a coolant stream composed of said liquid column bottoms, thereby to form a waste stream from said coolant stream after vaporization thereof; and said waste stream is partially warmed, thereby to produce said partially warmed stream.

10. The method of claim 8, wherein:

said tower overhead stream is condensed against vaporizing a coolant stream composed of said liquid column bottoms, thereby to form a waste stream from said coolant stream after vaporization thereof;

said waste stream and said second part of said compressed and purified air after having been expanded combine and are partially warmed to form said partially warmed stream.

11. The method of claim 8, wherein:

said tower overhead stream is condensed against vaporizing a coolant stream composed of said liquid column bottoms, thereby to form a waste stream from said coolant stream after vaporization thereof;

said waste stream is partially warmed; and said second part of said compressed and purified air stream after having been expanded is combined with said waste stream to form said partially warmed stream.

12. The method of claim 9 or claim 10 or claim 11 wherein:

said coolant stream comprises a first coolant stream;

a second coolant stream composed of a liquid phase of said first part of said compressed and purified air stream having a greater nitrogen content than that of said column bottoms also indirectly exchanges heat with said tower overhead stream and vaporizes;

the second coolant stream is expanded prior to its engaging in indirect heat exchange with said tower overhead stream;

said second coolant stream is recompressed to column pressure of said distillation column; and said second coolant stream is cooled to at or near dew point temperature and then introduced into said distillation column.

13. The method of claim 12, wherein a gaseous stream composed of said tower overhead is fully warmed in indirect heat exchange with said first part of said compressed and purified air stream, thereby to form a gaseous product nitrogen stream.

* * * * *